US007811021B2

(12) United States Patent
Gueret

(10) Patent No.: US 7,811,021 B2
(45) Date of Patent: Oct. 12, 2010

(54) PRODUCT APPLICATOR, IN PARTICULAR FOR COSMETICS

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 916 days.

(21) Appl. No.: 10/576,279

(22) PCT Filed: Oct. 14, 2004

(86) PCT No.: PCT/EP2004/013118

§ 371 (c)(1),
(2), (4) Date: Feb. 9, 2007

(87) PCT Pub. No.: WO2005/039350

PCT Pub. Date: May 6, 2005

(65) Prior Publication Data

US 2007/0277844 A1 Dec. 6, 2007

Related U.S. Application Data

(60) Provisional application No. 60/512,850, filed on Oct. 22, 2003.

(30) Foreign Application Priority Data

Oct. 17, 2003 (FR) ..... 03 50697

(51) Int. Cl.
*B43K 5/00* (2006.01)

(52) U.S. Cl. ..... 401/207; 401/205; 401/196

(58) Field of Classification Search ..... 401/196, 401/198, 199, 200, 203–207, 265, 266; 132/293, 132/317; 15/244.1, 244.3
See application file for complete search history.

(56) References Cited

U.S. PATENT DOCUMENTS

| | | | | |
|---|---|---|---|---|
| 4,174,415 | A * | 11/1979 | Bethe | 428/90 |
| 6,283,664 | B1 * | 9/2001 | Gueret | 401/261 |
| 6,745,781 | B2 * | 6/2004 | Gueret | 132/320 |
| 7,083,351 | B2 * | 8/2006 | Gueret | 401/196 |
| 2004/0120753 | A1 | 6/2004 | Gieux | |
| 2008/0163887 | A1 | 7/2008 | Gieux | |

FOREIGN PATENT DOCUMENTS

| | | |
|---|---|---|
| EP | 1 428 453 | 6/2004 |
| FR | 2 744 603 | 8/1997 |
| FR | 2 751 854 | 2/1998 |
| FR | 2 808 430 | 11/2001 |
| FR | 2 820 622 | 8/2002 |
| FR | 2 825 246 | 12/2002 |
| FR | 2 830 240 | 4/2003 |
| JP | 2000-287746 | 10/2000 |

* cited by examiner

*Primary Examiner*—David J Walczak
(74) *Attorney, Agent, or Firm*—Oblon, Spivak, McClelland, Maier & Neustadt, L.L.P.

(57) ABSTRACT

An applicator including an application face formed by a material incorporating a plurality of cells opening onto the application face via at least one emergent edge, the application face being at least partially covered by a flock coating formed from fibers, the average size of the cells being such that the surface on which the flocking fibers are placed is of a different profile from that of an envelope surface of the application face containing the emergent edges of the cells.

22 Claims, 4 Drawing Sheets

PRODUCT APPLICATOR, IN PARTICULAR FOR COSMETICS

BACKGROUND OF THE INVENTION

1. Field of the Invention

The present invention relates to applicators and devices for application of a product, in particular a cosmetic product.

2. Discussion of the Background

The expression "cosmetic product" is understood to mean a product as defined in Council Directive 93/35/EEC dated 14 Jun. 1993, amending Directive 76/768/EEC for the sixth time.

There are numerous known applicator devices which include a foam applicator one surface of which serves to apply a product to the skin, for example a powder, a milk or a cream.

To improve the evenness of the finished make-up or the comfort with which the product is applied, the foam is sometimes flocked.

Applicator pads are known, for example, that are formed by sponges having a very fine cell structure with flocked surface. These pads impart a very soft downy effect upon application. However, when the product to be applied is relatively viscous, these pads prevent the product from being released because the cells are blocked by the flocking adhesive. It is then necessary to use a small quantity of glue so as not to block the cells, which necessitates the use of short fibres to constitute the flock coating.

Applicators are also known that are made of very dense foam, with flocked surface, and incorporating a central hole to facilitate release of the product. Applicators of this kind do not enable the product to pass through the entire surface area of the applicator.

SUMMARY OF THE INVENTION

There is therefore a need for an application device incorporating an applicator that is both comfortable to use and capable of depositing the desired quantity of product onto the skin.

In one of its aspects, the object of the invention is to provide an applicator comprising an application face formed by a material incorporating a plurality of cells opening onto the application face via at least one emergent edge, the application face being at least partially covered by a flock coating formed from fibres, the average size of the cells being such that the surface on which the flocking fibres are placed is of a different profile from that of an envelope surface of the application face containing the emergent edges of the cells.

Within the context of the present invention, the expression "cell size" is understood to mean the largest cross section of the cell. For example, the cells have an average size greater than or equal to 0.60 mm, preferably greater than or equal to 0.70 mm, and more preferably greater than or equal to 1 mm.

By virtue of the invention, the application surface can be made more comfortable and more capable of being loaded with an increased quantity of product. In effect, as the cells are relatively large in size, the adhesive for the flock coating is applied inside the cells with open surface, following the walls of these cells. Thus, the adhesive does not block the cells, leaving a clear passage for the product which is able to pass through the applicator without obstruction. In addition, these surface emergent cells form cavities capable of accumulating product when the application surface is loaded. Consequently, the application surface has a greater product take-up capacity, which can improve the coverage and/or the useful working life of the applicator.

It is then possible to use a quantity of adhesive necessary for the attachment of fibres that are relatively long and therefore more pleasing to the touch, with no associated risk of blocking the cells, at the same time ensuring that the fibres are securely attached to the applicator.

In addition, the size of the cells allows air to pass through the applicator which in particular enables the distribution of a mixture of air and product.

Furthermore, the size of cells is such that when the applicator is arranged in a seating and in contact with a sidewall, and when it is caused to move along this wall, there is less friction with this wall than with an applicator made of a cellular material having smaller cells.

The cellular material can be porous.

The cellular material can be elastically deformable and/or compressible.

The cellular material can be a foam, in particular an open-cell foam. The foam is preferably composed of a majority of open cells.

The foam can be made of a material chosen from the following list polyurethane, polyether, polyester, polyvinyl chloride, polyethylene, EVA, latex, silicone, SIS, SEBS, elastomers of silicone, latex, nitrile, butyl, neoprene, NBR, SBR, without this list being limitative.

According to one embodiment, the applicator can incorporate a hollow recess, in particular so as to allow the product to pass in a preferred direction. The applicator can also include a stick of product accommodated in the recess.

The applicator can have a composite structure with several layers of different types, for example several types of foam. The applicator can for example include two assembled elements, the two elements defining for example an inner cavity, in particular an air-filled cavity, thereby giving the applicator greater flexibility on application.

The applicator can incorporate a slot or a hole emerging at the application surface.

The cellular material can have hydrophilic properties, and can in particular incorporate at least one hydro-absorbent compound, for example a polyacrylate. The applicator can also have lipophilic properties.

The cellular material can incorporate at least one biocidal agent, in particular a bactericidal and/or bacteriostatic and/or antifungal agent. Examples of biocidal agents are described in French patent application FR 2 804 846.

The flock coating can include fibres selected from fibres of lengths ranging from 0.01 to 3 mm; diameter ranging from 0.01 to 0.6 mm; of circular, oval, polygonal, cruciform, trilobate, tetralobate cross-section, in the shape of a "C", "E", "F", "H", "I", "L", "N", "S", "T", "V", "W", "X", "Y", "Z", or in the shape of a star or crescent; straight fibres and curved fibres, polyamide, polyacrylic or polyester fibres, cotton or cellulose fibres, or a mixture of different fibres chosen from the above.

The applicator can have any shape and in particular any cross-section. The applicator can have a circular, oval, or polygonal transverse cross-section, for example triangular, square, hexagonal, etc.

The applicator can be a simple sponge for example, independent of any supporting element.

Alternatively, the applicator can be integral with a support composed of a grasping element so as to form an application device.

The application device can also include a container holding a product to be applied, in particular a cosmetic product. The applicator can then be used to take up product from the container, and can for example be stored in the container when the latter is closed and when not in use. The applicator can be integral with the container, in which case the container constitutes the grasping element. The applicator can for example be glued or welded around an opening in the container.

The device can also include a closure element intended to close the container, preferably in a leaktight manner. The applicator can then be integral with the closure element, the closure element constituting the grasping element.

The product can be a fluid product, in particular a powder, a cream, a gel, or a liquid. Alternatively, the product can be a dispensable solid.

BRIEF DESCRIPTION OF THE DRAWINGS

The invention will be better understood from the following detailed description of non-limitative embodiments, and by reference to the attached drawings in which:

FIGS. 1 to 3 are diagrammatic representations of the cells of a foam material designed for example to constitute an applicator, in particular for a cosmetic product. The foam includes cells which open onto an application face via at least one emergent edge, the application face being at least partially covered in a flock coating formed from fibres.

DETAILED DESCRIPTION OF THE PREFERRED EMBODIMENTS

Figure 1:
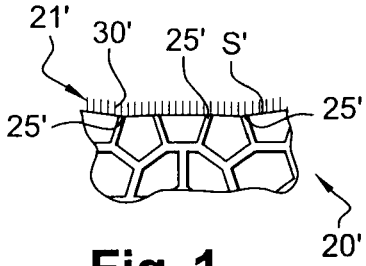
Fig. 1 Prior Art
FIG. 1 is a diagrammatic sectional view of the cells of a foam material covered with a flock coating forming an applicator according to the prior art.

In particular, FIG. 1 shows the cells of a foam material forming an applicator according to the prior art, that is a foam material 20' having cells of relatively small size. The foam 20' includes cells which open onto an application face 21' via at least one emergent edge 25'. The application face 21' is covered in a flock coating 30'. As the cells are relatively small, the flocking adhesive is applied in film form by forming a surface S' passing over the emergent edges 25'. The fibres of the flock coating are then set on a surface corresponding to the envelope surface S' of the application face containing the emergent edges 25' of the cells, so that the flock coating blocks the cells, as can be seen in FIG. 1. In addition, all of the fibres are perpendicular to the application face 21'.

Figure 2:
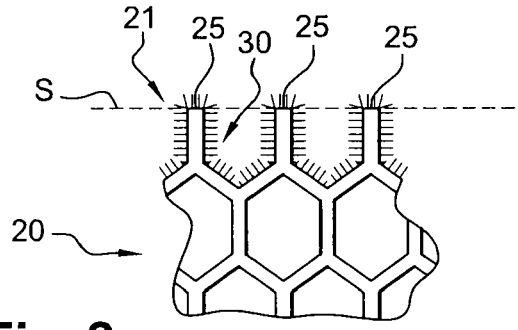
FIGS. 2 and 3 are diagrammatic sectional views of the cells of a foam material covered with a flock coating forming an applicator according to the invention.
Figure 3:
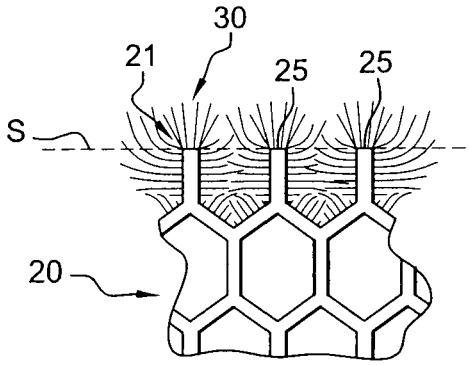

FIGS. 2 and 3 illustrate the cells of a foam material forming an applicator according to the invention, i.e. a foam material 20 having cells of relatively large size. The foam 20 includes partial cells which open onto an application face 21 via at least one emergent edge 25. Here again, the application face 21 is covered in a flock coating 30. According to the invention, by using a foam material 20 with cells of larger size, the adhesive for the flock coating 30 is applied inside the open partial cells at the surface, conforming to the walls of these cells. The surface on which the flocking fibres are set does not therefore correspond to the envelope surface S of the application face containing the emergent edges 25 of the partial cells. Thus, the adhesive does not block the cells thereby leaving a clear passage for the product. As the partial cells opening onto the application face 21 are relatively large, they thus constitute cavities capable of accumulating product when the application face is loaded. Thus, the application surface has a greater product take-up capacity, which can improve the coverage and/or the useful working life of the applicator.

In addition, the fibres of the flock coating thus bonded are not all perpendicular to the surface S defined by the edges 25 and are therefore not all mutually parallel. This makes it possible to distribute the product over the surface in a differential manner, given that the fibres form reserves of product different from the reserves that can be formed by mutually parallel fibres. Furthermore, by using relatively long fibres as illustrated in FIG. 3, only the fibres of the flock coating are effectively visible and the relatively large cells of the foam material are practically invisible, which improves the appearance of the applicator.

A foam material of this kind can be used in various applicator configurations which are now to be described in accordance with FIGS. 5-17. On all these figures, the fibres of the flock coating were represented schematically but it is evident that fibres are distributed on the application face of applicators as illustrated on FIGS. 2 and 3.

The applicator can for example be integral with a support, as will now be described in reference to FIGS. 5 to 16.

FIGS. 5 to 9 illustrate examples of applicator devices intended to apply a lip colour.

Figure 5:
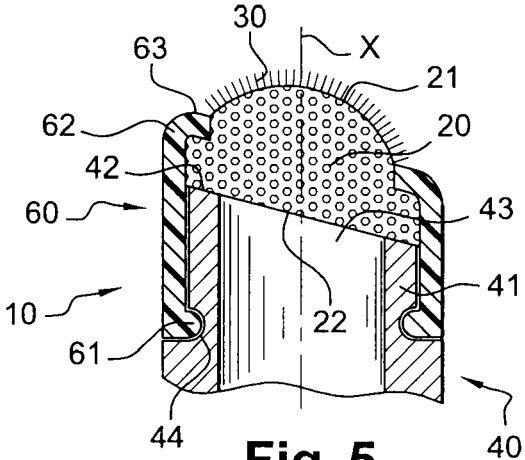
FIGS. 5 to 17 illustrate different embodiments of application devices including a foam applicator according to the present invention.

The device 10 depicted in FIG. 5 includes a container 40 that is cylindrical in shape about an axis X and having a neck 41 of which the upper edge 42 delineates an opening 43 extending in an oblique plane relative to the axis X. The container contains a liquid lip colour for example.

Figure 4:
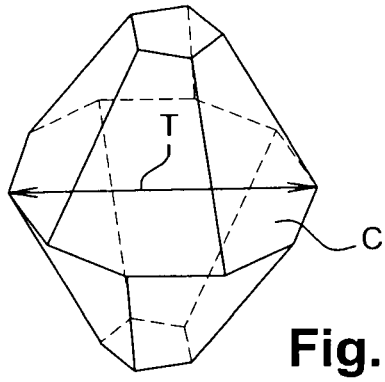
FIG. 4 is a diagrammatic perspective view of one cell in a foam material.

In a particular example, the device includes an applicator 20 consisting of a block of polyurethane foam of which one cell is shown in diagrammatic perspective view in FIG. 4. The cell is formed by a plurality of interconnected walls in the shape of two polyhedrons having a common base C, the two polyhedrons being substantially symmetrical relative to the Base C. The average size T of the cell, corresponding to the largest cross-section of the base C, is for example between 0.8 and 3 mm and preferably between 1 and 2 mm.

The applicator 20 is, for example, circular in transverse cross-section. The applicator includes for example a domed application surface 21 and, opposite the application surface, a flat base 22 which extends in an oblique plane relative to the axis X.

The application surface 21 is covered by a flock coating 30 composed of fibres, in particular fibres of polyamide, rayon, polyester, viscose or cotton. The fibres can be of different or substantially identical diameters, lengths and types, in relation to the product intended to be applied. The length of the fibres can be 0.5 mm or more, for example.

To apply the flock coating, the area of the foam material forming the application surface 21 is coated with adhesive on its outer surface by partial or total immersion in an adhesive bath, and fibres are then deposited thereon by electrostatic means.

The applicator 20 is arranged at the upper end of the container in a manner such that it is in fluid communication with the product held in the container. The periphery of the base 22 of the applicator bears on the upper edge of the neck 42. The applicator 20 is held on the neck of the container by a cylindrical end-piece 60 of which the side wall surrounds the applicator. The end-piece 60 incorporates a boss 61 at its base which snaps into an annular groove 44 provided on the container. The upper end 62 of the end-piece extends in an oblique plane relative to the axis X of the container so that the end-piece presents a generally bevelled shape. The end-piece terminates at its upper end 62 by a flanged return 63 which wraps over the edge of the applicator so as to hold it against the container.

Figure 6:
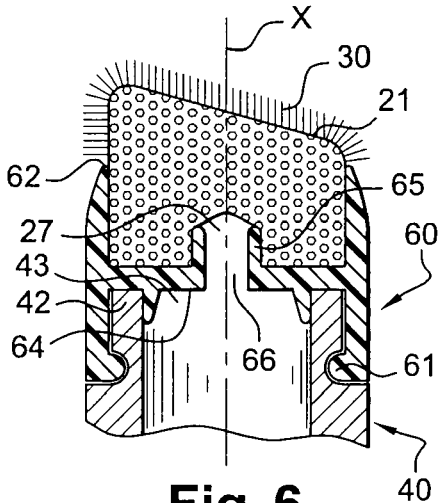

FIG. 6 illustrates a device which in this instance includes an applicator having a flat application surface 21 extending in an oblique plane relative to the axis X of the container 40. The applicator also incorporates a recess 27 in its central portion.

The applicator is mounted on the container via a cylindrical end-piece 60 attached to the container at its base by means of a snap-on boss 61, and of which the upper end 62 extends in this instance in a plane perpendicular to the axis X. The end-piece 60 has a transverse wall 64 which bears on the upper edge 42 and which partially closes off the opening 43 in the container. The transverse wall includes an axial riser 65 which delineates a passage 66 emerging substantially at the centre of the applicator. The riser in particular serves to channel the product from the container into the central part of the application surface. The applicator is in this instance welded onto the transverse wall of the end-piece.

Figure 7:
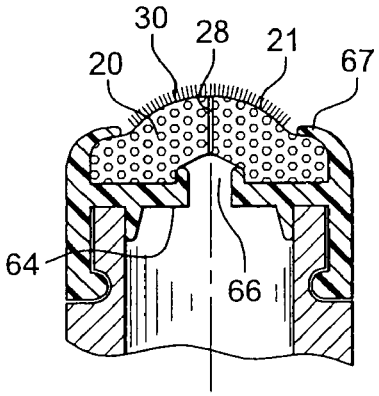

Instead of being welded to the end-piece, the applicator can be held on the end-piece by crimping as illustrated in FIG. 7. The foam is compressed by a frame 67, for example. In addition, the applicator 20 can include a slot 28 emerging at the application surface 21.

Figure 8:
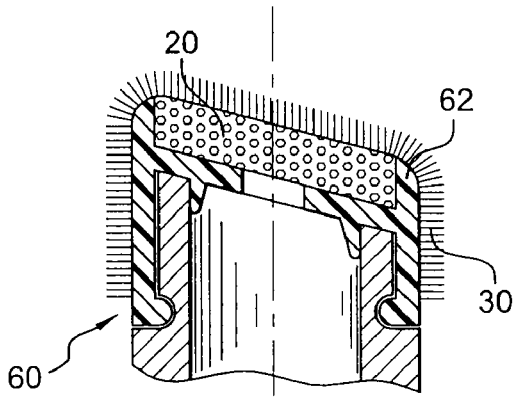

Instead of applying the flock coating to the application surface before mounting the applicator on the end-piece, the flock coating can be applied after arranging the applicator 20 in the end-piece 60. The upper end 62 of the end-piece can then also be covered with flock coating 30 as illustrated in FIG. 8.

Figure 9:
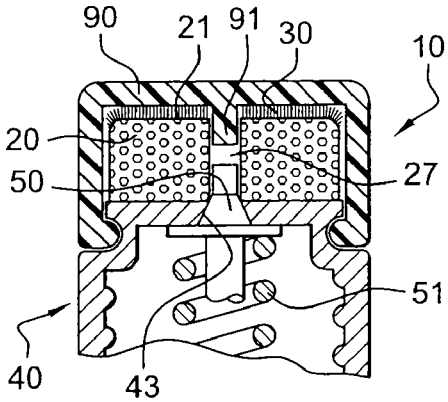

FIG. 9 illustrates a device which in this instance includes a cylindrical applicator 20 having an application surface 21 covered by a flock coating 30. The applicator 20 also incorporates a recess 27 in its central portion which extends over the full axial height of the applicator and which emerges at the application surface 21. The recess 27 is arranged opposite the opening 43 in the container which in this instance is closed by a valve 50 so that the applicator is in selective fluid communication with the product held in the container. When the application surface is applied against the area to be treated, the applicator 20 is compressed and the valve 50 is depressed thereby opening the passage 43 for the product. A spring 51 is provided to return the valve to its closed position when the pressure exerted on the applicator is released. A closure cap 90 is provided to cover the applicator, the cap being fitted with a stud 91 which lodges in the recess 27 in the closed position thereby enhancing the leaktight closure of the device.

Figure 10:
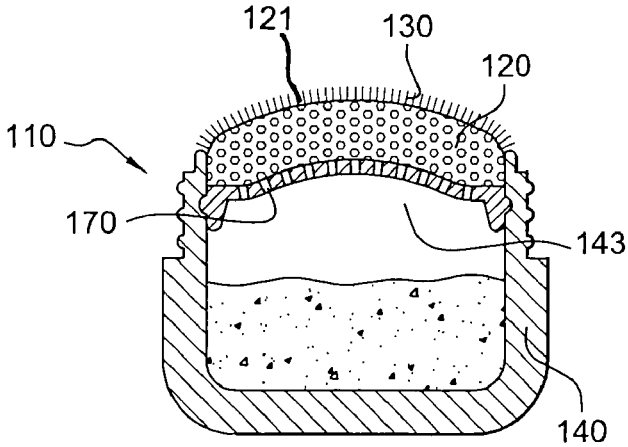

The applicator according to the invention can also be used in devices 110 intended to apply a powder. By way of example, FIG. 10 illustrates a powder pot fitted with an applicator 120 according to the invention. The applicator 120 is mounted in the opening 143 of a container 140 on a mesh 170 designed to retain the loose powder by capillary action. The application surface 121 of the applicator 120 is covered in a flock coating 130.

The applicator according to the invention can also be used on tube caps.

Figure 11:
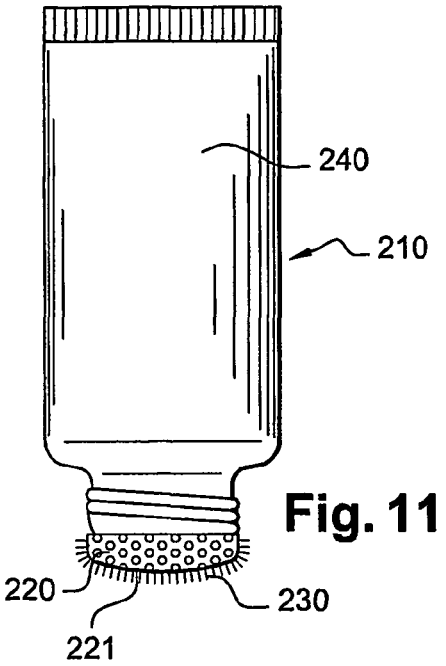

By way of example, FIG. 11 illustrates a device 210 including a container 240 holding a cosmetic product, and an applicator 220 capable of being traversed by the product held in the container and presenting an application surface 221 covered in a flock coating 230.

The applicator can be compressed by a closure cap, not shown, fitted on the container, in which case it can expand when said cap is removed.

The product can be forced through the applicator by any means, for example by virtue of the fact that the container wall is compressible. In a variant, the container can have a cylindrical wall and can be equipped with a plunger and a screw mechanism to drive the plunger.

Figure 12:
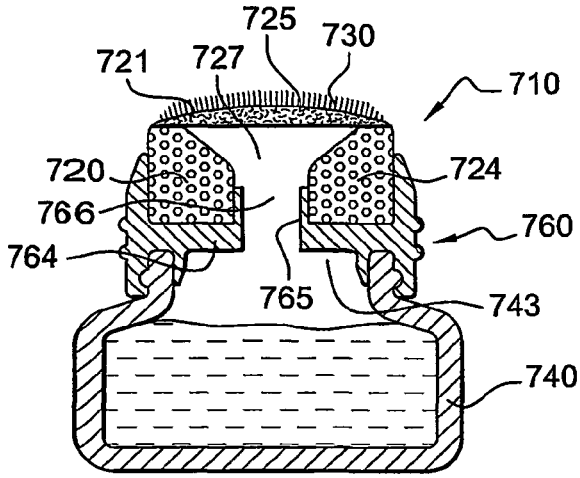

FIG. 12 also depicts a device 710 in which the applicator 720 is compressed by a closure cap, not shown, in the closed position.

The applicator 720 is mounted on the container by means of a cylindrical end-piece 760 which snaps onto the container 740 at its base. The end-piece 760 incorporates a transverse wall 764 which partially closes off the opening 743 in the container. The transverse wall includes an axial riser 765 which delineates a passage 766 emerging substantially at the centre of the applicator.

The applicator 720 is formed by two blocks of foam 724 and 725. A first block 724 constitutes the side walls of the applicator and a second block, in the form of a cap 725, is welded onto the first block 724 to form the application surface 721. The applicator 720 has an axial recess 727 including a cylindrical portion in which the riser 765 is located and a tapered portion which tapers from the cylindrical portion up to the cap 725 so as to delineate an internal cavity capable of holding a product reserve. This embodiment can be used for example to apply a cosmetic product in powder form.

Figure 13:
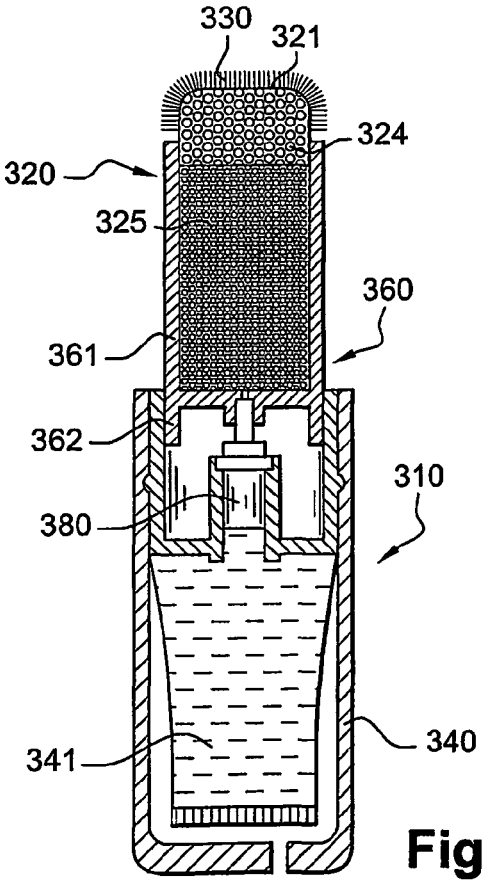

FIG. 13 illustrates a device 310 wherein the product can be dispensed by means of a pump 380 by being drawn from a flexible pocket 341 arranged in an outer container 340. The device includes a detachable unit 360 which takes the form of a cartridge having a tubular wall 361 defining a seating containing an applicator 320. The cartridge 360 can include a wall 362 intended to guide its movement in the container 340 when the pump 380 is actuated.

The applicator 320 can be composed of a single block of foam, as in the examples depicted in FIGS. 5 to 11 or, as a variant, by the assembly of at least two foam elements 324 and 325, as depicted in FIG. 13. One of the foam elements 324 defines an application surface 321 covered by a flock coating 330. The other element 325 can serve as a product reserve when the detachable unit is separated from the container 340.

Figure 14:
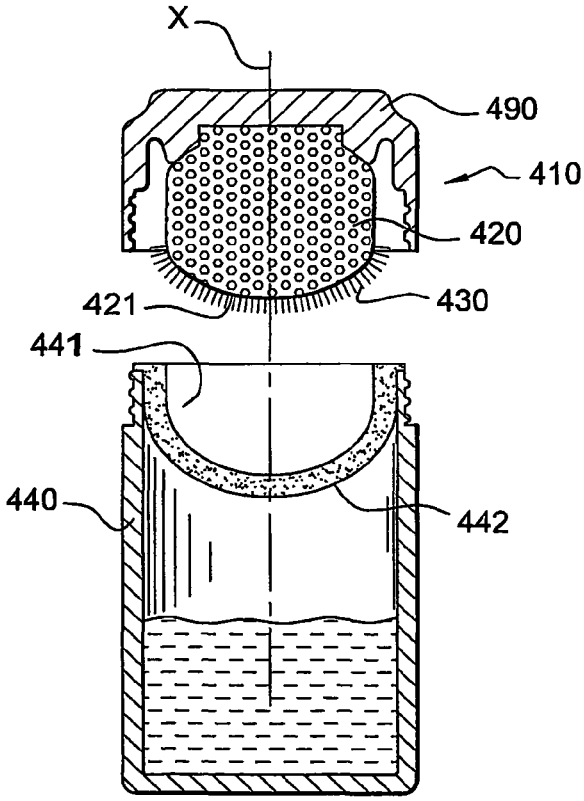

FIG. 14 illustrates a device 410 including a container 440 and an applicator 420 supported by a grasping element 490 which can also form a closure element for the container. The applicator 420 has an application surface 421 covered by a flock coating 430. The container 440 includes a seating 441 capable of accommodating the applicator 420. The seating is defined by an element 442 made of foam, this element being permeable to the product thereby allowing the latter to reach the applicator.

Figure 15:
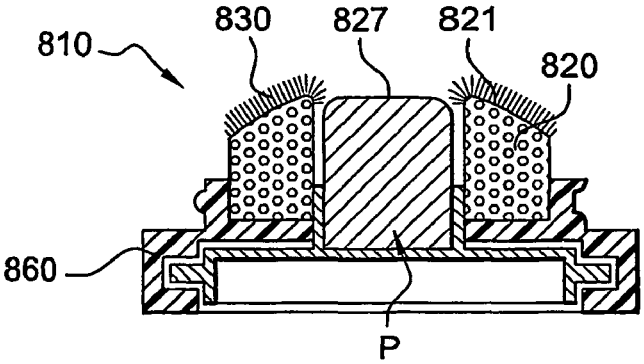

FIG. 15 illustrates another example of an applicator device 810 in which the applicator 820 incorporates an axial recess 827 in its central portion which extends over the full axial height of the applicator and which emerges at the application surface 821 covered by a flock coating 830. The recess 827 serves as a seating for the product which takes the form of a stick of solid product P, the stick being held in a fixed position on the end-piece 860. The upper surface of the product stick P is set back slightly from the application surface 821. When the application surface is applied against the area to be treated, the applicator 820 is compressed so that the upper surface of the product stick P comes into contact with the surface to be treated. The product can then be spread by the application surface 821 of the applicator 820.

Figure 16:
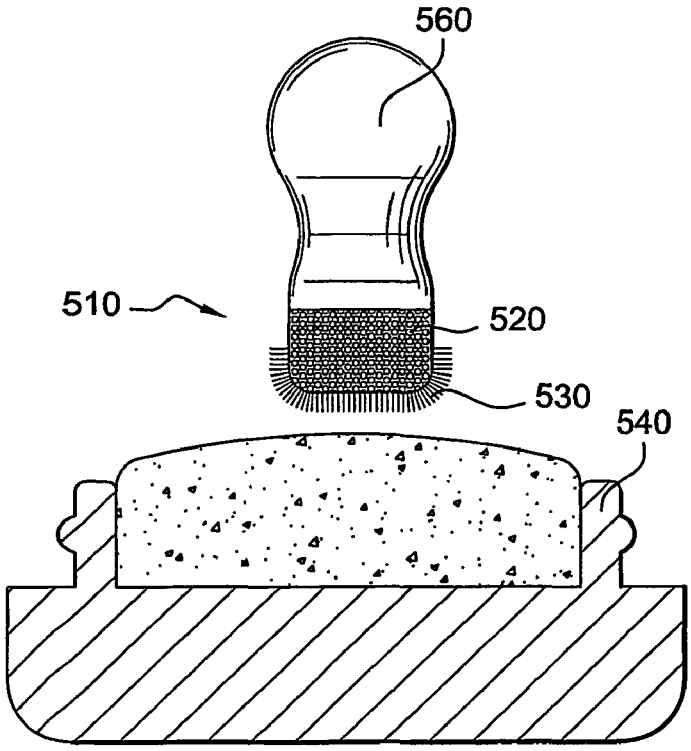

FIG. 16 illustrates another example of an applicator device 510 in which the applicator 520 is integral with a handle 560. This applicator 520, which can be covered by a flock coating 530 may be intended for example to be placed in contact with a product held in a container 540 so as to be impregnated with the product by capillary action.

Figure 17:
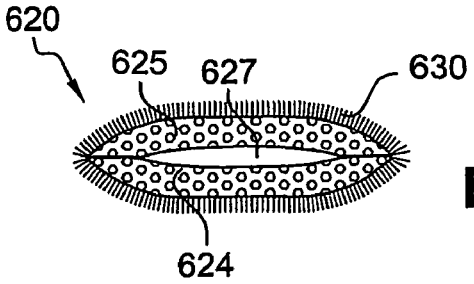

In all of the examples just described, the applicator is integral with a support. In another configuration, the applicator can be used by itself, i.e. in the form of a pad, and used to take up a product held in a container. At least part of its outer surface is then covered by a flock coating. The pad can be composed of a single block of foam or can be made by superimposing several blocks of foam welded together. By way of example, FIG. 17 illustrates a pad 620 formed by assembling two disc-shaped foam elements 624 and 625. The two elements form an air-filled cavity 627 between them. These two elements can be assembled by welding their edges together around the cavity. The external surface of the pad is either partially covered or, as depicted in FIG. 17, completely covered in a flock coating 630.

The invention is not limited to the examples described above, and the features of the different embodiments may be variously combined.

Throughout the description, including the claims, the expression "including one" should be understood to be synonymous with "including at least one", unless specified otherwise.

The invention claimed is:

1. An applicator comprising an application face comprising a material comprising cells, wherein the material opens onto the application face via at least one emergent edge, wherein the application face is at least partially covered by a flock coating, wherein the flock coating comprises fibers, wherein the majority of cells on the application face comprises partial cells, wherein the partial cells comprise multiple surfaces that are not all parallel to each other, and wherein the flock fibers are adhered to several of the multiple surfaces of at least some of the partial cells such that the flock fibers are not all parallel to each other.

2. The applicator of claim 1, wherein the material is porous.

3. The applicator of claim 1, wherein the material is elastically deformable.

4. The applicator of claim 1, wherein the material is compressible.

5. The applicator of claim 1, wherein the material is a foam.

6. The applicator of claim 5, wherein the foam is an open-cell foam.

7. The applicator of claim 5, wherein the foam comprises a material selected from the group consisting of polyurethane, polyether, polyester, polyvinyl chloride, polyethylene, EVA, latex, silicone, SIS, SEBS, elastomers of silicone, latex, nitrile, butyl, neoprene, NBR and SBR.

8. The applicator of claim 1, wherein the applicator is recessed.

9. The applicator of claim 1, further comprising two assembled cellular elements.

10. The applicator of claim 9, wherein the two elements define an inner cavity.

11. The applicator of claim 1, further comprising a slot or a hole emerging at the applicator surface.

12. The applicator of claim 1, wherein the material has hydrophilic or lipophilic properties.

13. The applicator of claim 1, wherein the material further comprises at least one hydro-absorbent compound.

14. The applicator of claim 1, wherein the material further comprises at least one biocidal agent.

15. The applicator of claim 1, wherein the length of the fibres ranges from 0.01 to 3 mm;

wherein the diameter of the fibers ranges from 0.01 to 0.6 mm; wherein the shape of the fibers is selected from the group consisting of circular, oval, polygonal, cruciform, trilobate, tetralobate "C", "E", "F", "H", "I", "L", "N", "S", "T", "V", "W", "X", "Y", "Z", star, crescent, straight curved, and mixtures thereof, and wherein the fibers comprise a material selected from the group consisting of polyamide, polyacrylic, polyester, cotton, cellulose, or a mixture thereof.

16. A device comprising the applicator of claim 1 and a grasping element for the applicator.

17. The device of claim 16, further comprising a container comprising a product to be applied.

18. The device of claim 17, wherein the container constitutes the grasping element.

19. The device of claim 18, wherein the applicator is glued or welded around an opening in the container.

20. The device of claim 17, further comprising a closure element capable of closing the container.

21. The device of claim 20, wherein the applicator is integral with the closure element, and wherein the closure element comprises a grasping element.

22. The applicator of claim 1, wherein each cell has a cell size greater than or equal to 0.6 mm.

* * * * *